US010724404B2

(12) United States Patent
Takamura

(10) Patent No.: US 10,724,404 B2
(45) Date of Patent: Jul. 28, 2020

(54) VANE, GAS TURBINE, RING SEGMENT, REMODELING METHOD FOR VANE, AND REMODELING METHOD FOR RING SEGMENT

(71) Applicant: MITSUBISHI HITACHI POWER SYSTEMS, LTD., Kanagawa (JP)

(72) Inventor: Keita Takamura, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 373 days.

(21) Appl. No.: 15/324,777

(22) PCT Filed: Jun. 29, 2015

(86) PCT No.: PCT/JP2015/068623

§ 371 (c)(1),
(2) Date: Jan. 9, 2017

(87) PCT Pub. No.: WO2016/021330

PCT Pub. Date: Feb. 11, 2016

(65) Prior Publication Data

US 2017/0211421 A1 Jul. 27, 2017

(30) Foreign Application Priority Data

Aug. 4, 2014 (JP) ..... 2014-158828

(51) Int. Cl.
*F01D 9/04* (2006.01)
*F01D 25/24* (2006.01)
*F01D 11/00* (2006.01)

(52) U.S. Cl.
CPC ..... *F01D 25/243* (2013.01); *F01D 9/041* (2013.01); *F01D 9/042* (2013.01); *F01D 11/003* (2013.01);
(Continued)

(58) Field of Classification Search
CPC ..... F01D 9/041; F01D 11/08; F01D 21/003; F01D 25/246; F01D 9/042; F01D 9/047;
(Continued)

(56) References Cited

U.S. PATENT DOCUMENTS 3,362,160 A * 1/1968 Bourgeois ..... F01D 21/003 415/118
3,909,157 A * 9/1975 Wachtell ..... B23P 6/005 29/889.1

(Continued)

FOREIGN PATENT DOCUMENTS

CA 2712756 A1 * 2/2011
CN 101684736 3/2010

(Continued)

OTHER PUBLICATIONS

Ruitao Qu, Peng Zhang, Zhefeng Zhang, "Notch Effect of Materials: Strengthening or Weakening?", May 6, 2014, Shenyang National Laboratory for Materials Science, Institute of Metal Research, Chinese Academy of Sciences, Shenyang 110016, China, p. 600-609 (Year: 2014).*

(Continued)

*Primary Examiner* — Woody A Lee, Jr.
*Assistant Examiner* — Brian Christopher Delrue
(74) *Attorney, Agent, or Firm* — Wenderoth, Lind & Ponack, L.L.P.

(57) ABSTRACT

A vane (18) has an airfoil section (19) that extends in a radial direction and an outer shroud (20) that is disposed on the radially outward side of the airfoil section (19), and is supported inside a casing by means of a vane support member (24). The outer shroud (20) has a shroud body (31), radial protrusions (36, 37), and a hook section (32) including the radial protrusions (36, 37) and engaging parts (39, 40). A recessed part (50), which is recessed in an axial direction
(Continued)

or in the radial direction, is provided in at least a part of the circumference of the hook section (32). The engaging part (39) has a sealing surface that continues along the entire circumference thereof, the sealing surface coming into contact with the vane support member (24) in the radial direction.

16 Claims, 10 Drawing Sheets

(52) U.S. Cl.
CPC ..... *F01D 25/246* (2013.01); *F01D 11/005* (2013.01); *F05D 2230/80* (2013.01); *F05D 2260/941* (2013.01)

(58) Field of Classification Search
CPC ..... F05D 2220/32; F05D 2240/12; F05D 2240/80; F05D 2260/30
USPC ..... 415/203.3
See application file for complete search history.

(56) References Cited

U.S. PATENT DOCUMENTS 4,639,189 A * 1/1987 Rosman ..... F01D 9/041 415/115
4,687,413 A * 8/1987 Prario ..... F01D 11/08 403/319
4,720,236 A * 1/1988 Stevens ..... F01D 9/042 415/116
4,856,963 A * 8/1989 Klapproth ..... F01D 9/042 415/190
5,176,496 A * 1/1993 Correia ..... F01D 9/042 415/189
5,248,240 A * 9/1993 Correia ..... F01D 9/042 415/191
5,846,050 A * 12/1998 Schilling ..... F01D 9/04 415/135
6,050,776 A * 4/2000 Akagi ..... F01D 5/22 415/138
6,109,873 A * 8/2000 Brooks ..... F01D 5/147 416/62
6,273,676 B1 * 8/2001 Brooks ..... F01D 5/147 415/191
6,296,443 B1 * 10/2001 Newman ..... F01D 9/042 415/189
6,494,677 B1 * 12/2002 Grady ..... B23P 6/002 29/889.7
6,575,703 B2 * 6/2003 Simeone ..... F01D 5/066 416/220 R
6,699,011 B2 * 3/2004 Cot ..... F01D 9/04 415/173.1
7,258,525 B2 * 8/2007 Boeck ..... F01D 9/042 415/191
7,704,042 B2 * 4/2010 Brueckner ..... F01D 9/042 415/121.3
8,092,163 B2 * 1/2012 Shapiro ..... F01D 9/042 415/189
8,220,150 B2 * 7/2012 Pellet ..... B23P 6/002 29/889
RE43,928 E * 1/2013 Clouse ..... F01D 17/02 415/115
8,356,981 B2 * 1/2013 Cooke ..... F01D 9/042 416/214 A
8,684,674 B2 * 4/2014 Chan ..... F01D 11/001 415/119
9,683,459 B2 * 6/2017 Aoki ..... F01D 25/246
9,752,446 B2 * 9/2017 Boeke ..... F01D 9/04
9,759,079 B2 * 9/2017 Sippel ..... F01D 11/005
9,803,488 B2 * 10/2017 Riley ..... F01D 9/041
9,915,158 B2 * 3/2018 Graf ..... F01D 9/023
2006/0013685 A1 * 1/2006 Ellis ..... F01D 9/041 415/210.1
2006/0078429 A1 * 4/2006 Darkins, Jr. ..... F01D 9/04 415/209.2
2006/0291998 A1 * 12/2006 Dube ..... F01D 17/02 415/118
2007/0025837 A1 * 2/2007 Pezzetti, Jr. ..... F01D 11/005 415/115
2007/0122275 A1 * 5/2007 Busch ..... F01D 9/042 415/209.3
2008/0080970 A1 * 4/2008 Cooke ..... F01D 9/042 415/173.3
2008/0152485 A1 * 6/2008 Kammel ..... F01D 9/041 415/189
2009/0246014 A1 * 10/2009 Shapiro ..... F01D 9/042 415/209.3
2010/0028143 A1 * 2/2010 Bailey ..... B23P 6/002 415/202
2010/0068041 A1 * 3/2010 Nigmatulin ..... F01D 9/04 415/173.1
2011/0044803 A1 * 2/2011 Di Paola ..... F01D 9/04 415/173.1
2012/0163993 A1 * 6/2012 Levine ..... B22C 9/10 416/97 R
2013/0011265 A1 * 1/2013 Miller ..... F01D 11/008 416/191
2013/0108434 A1 * 5/2013 Judet ..... F01D 9/042 415/208.2
2013/0115065 A1 * 5/2013 Correia ..... F01D 11/005 415/182.1
2013/0202409 A1 * 8/2013 Jones ..... F01D 5/189 415/115
2013/0259646 A1 * 10/2013 Feindel ..... F01D 21/003 415/118
2013/0287995 A1 * 10/2013 Deobald ..... B29D 99/0014 428/120
2014/0119902 A1 * 5/2014 Feldmann ..... F01D 11/08 415/173.1
2014/0147263 A1 * 5/2014 Bergman ..... F01D 9/042 415/208.1
2015/0030443 A1 * 1/2015 Richardson ..... F01D 5/22 415/210.1
2015/0098829 A1 * 4/2015 Baldiga ..... F01D 11/003 416/179
2015/0226075 A1 * 8/2015 Aoki ..... F01D 25/246 415/209.3
2015/0292342 A1 * 10/2015 Ring ..... F01D 9/041 415/208.2
2016/0153296 A1 * 6/2016 Ols ..... F01D 5/082 415/1
2016/0153299 A1 * 6/2016 Tuertscher ..... F01D 5/14 415/115
2016/0290147 A1 * 10/2016 Weaver ..... F02C 3/04
2016/0312658 A1 * 10/2016 Heitman ..... F01D 25/28
2017/0002675 A1 * 1/2017 Lutjen ..... F01D 9/042
2017/0370240 A1 * 12/2017 Sippel ..... F01D 11/005

FOREIGN PATENT DOCUMENTS

EP 0874131 10/1998
EP 2921652 A4 * 9/2016 ..... F01D 25/246
FR 2961850 12/2011
GB 2462268 2/2010
GB 2462268 A * 2/2010 ..... F01D 9/041
JP 2004-257389 9/2004
JP 4049754 2/2008
JP 2010-65698 3/2010
JP 4781244 9/2011

OTHER PUBLICATIONS

Joseph F. Murphy, "Strength and Stiffness Reduction of Large Notched Beams", Journal of Structural Engineering, vol. 112, No. 9, Sep. 1986. p. 1989-2000 (Year: 1986).*

(56) References Cited

OTHER PUBLICATIONS

International Search Report dated Jul. 28, 2015 in International Application No. PCT/JP2015/068623 (with English translation).
Written Opinion of the International Searching Authority dated Jul. 28, 2015 in International Application No. PCT/JP2015/068623 (with English translation).

* cited by examiner

VANE, GAS TURBINE, RING SEGMENT, REMODELING METHOD FOR VANE, AND REMODELING METHOD FOR RING SEGMENT

TECHNICAL FIELD

The present invention relates to a vane, a gas turbine, a ring segment, a remodeling method for a vane, and a remodeling method for a ring segment.

Priority is claimed on Japanese Patent Application No. 2014-158828, filed on Aug. 4, 2014, the content of which is incorporated herein by reference.

DESCRIPTION OF THE RELATED ART

A gas turbine vane is known that has shrouds formed on a radially inward side and a radially outward side of the airfoil section. The outer shroud located on the radially outward side is provided with a hook on the outer side. The outer shroud is usually supported by an insulating ring or casing through the hook.

Of the vane thus constructed, the airfoil section is arranged in a gas path through which a high-temperature working fluid flows. Cooling air flows on the side of the shroud of the vane opposite from the gas path. The outer shroud tries to deform so as to warp toward the radially outward side due to a large temperature difference between the high-temperature working fluid inside the gas path and the cooling air.

The hook provided on the shroud protrudes to a large extent in the radial direction of the shroud. Thus, the hook has a high moment of inertia of area relative to the warping deformation of the shroud. As a result, the hook restricts the deformation of the shroud body, causing high heat stress on the shroud.

Patent Document 1 shows a turbine vane in which a hook does not continuously extend in a circumferential direction, but instead a recessed part having a shape of scallop is formed in order to relax mechanical stress and heat stress. Patent Document 1 further discloses a sealing assembly having a sealing member which is arranged so as to at least partially overlap the recessed part to prevent a fluid from leaking through the recessed part.

Patent Document

Patent Document 1: JP4781744B

SUMMARY OF THE INVENTION

Problems the Invention is to Solve

If the recessed part is formed in the hook in order to relax the stress and the sealing assembly is disposed so as to cover the recessed part as disclosed in Patent Document 1, cooling air is capable of leaking through gaps between parts around the recessed part. Therefore, the cooling air flowing into the gas path increases, which may degrade the performances of the gas turbine.

An object of the present invention is to provide a vane, a gas turbine, a ring segment, a remodeling method for a vane, and a remodeling method for a ring segment which can reduce heat stress and also restrict an increase in amount of air leakage.

Solution to Problem

According to a first aspect of the present invention, a vane includes an airfoil section extending in a radial direction and an outer shroud located on the radially outward side of the airfoil section, and is supported inside a casing by a vane support member. The outer shroud includes a hook section and a shroud body. The hook section has a radial protrusion, and an engaging part. The shroud body extends in an axial direction and a circumferential direction. The radial protrusion is provided on the radially outward side of the shroud body, protrudes toward the radially outward side, and extends in the circumferential direction. The engaging part protrudes in the axial direction from the radial protrusion and extends in the circumferential direction. The hook section includes a recessed part recessed in the axial direction or the radial direction in at least a part of the circumference. The engaging part has a sealing surface which contacts the vane support member in the radial direction continuously along the entire circumference of the engaging part.

The vane thus constructed is capable of reducing the stiffness of the hook section by the recessed part. Therefore, the hook section is capable of deforming following a deformation of the shroud body due to heating. The hook section has the recessed part recessed in the axial direction or the radial direction, and yet the sealing surface is not split by the recessed part in the circumferential direction. As a result, it is possible to limit an increase in the amount of air leakage and relax heat stress.

According to a second aspect of the present invention, the hook section of the vane according to the first aspect may have a front hook arranged on the upstream side in the axial direction. The engaging part of the front hook may have a sealing surface on the radially inward side.

The recessed part of the vane thus constructed is capable of reducing the stiffness of the front hook having the sealing surface on the radially inward side without splitting the sealing surface. As a result, it is possible to limit an increase the amount of air leakage and relax the heat stress acting on the front hook side of the shroud body.

According to a third aspect of the present invention, in the vane in the second aspect, an area in the circumferential direction, in which the recessed part is arranged, may include a position in the circumferential direction at which a leading edge of the airfoil section is arranged.

The vane thus constructed is capable of relaxing stress at a highly stressed area in the leading edge.

According to a fourth aspect of the present invention, the hook section of the vane according to any one of the first to third aspects of the present invention may include a rear hook arranged on the downstream side in the axial direction. The engaging part of the rear hook may include a sealing surface on the radially outer circumferential side.

The recessed part of the hook section thus constructed is capable of relaxing the stress acting on the rear hook side of the shroud body by reducing the stiffness of the rear hook having the sealing surface on the radially outer circumferential side.

According to a fifth aspect of the present invention, in the vane of the fourth aspect, an area in the circumferential direction, in which the recessed part is formed, may include a position in the circumferential direction at which a trailing edge of the airfoil section is arranged.

The vane thus constructed is capable of relaxing stress at a highly stressed area in the trailing edge of the airfoil section.

According to a sixth aspect of the present invention, in the vane of any one of the first, second, and fourth aspects an area in the circumferential direction, in which the recessed part is formed, my include the center in the circumferential direction of the hook section.

The vane thus constructed is capable of effectively reducing the stiffness of the hook section relative to a bending deformation of the shroud.

According to a seventh aspect of the present invention, a ring segment of a gas turbine is supported in a casing of the gas turbine by a ring segment support member, and delimits an outer circumference of an annular high-temperature gas passage. This ring segment has a hook section and a ring segment body. The hook section has a radial protrusion, and an engaging part. The ring segment body extends in an axial direction and a circumferential direction. The radial protrusion is provided on the radially outward side of the ring segment body, protrudes toward the radially outward side, and extends in the circumferential direction. The engaging part protrudes in the axial direction from the radial protrusion and extends in the circumferential direction. The hook section has a recessed part recessed in the axial direction or the radial direction in at least a part of the circumference. The engaging part has a sealing surface which contacts the ring segment support member in the radial direction continuously along the entire circumference of the engaging part.

The recessed part of the ring segment thus constructed is capable of reducing the stiffness of the hook section thereof. Therefore, the hook section is capable of deforming following a deformation of the heated ring segment body. The hook section has the recessed part recessed in the axial direction or the radial direction. The engaging part has the sealing surface extending continuously along the entire circumference of the engaging part. Therefore, the recessed part does not split the sealing surface in the circumferential direction. As a result, it is possible to limit an increase in amount of air leakage and relax heat stress.

According to an eighth aspect of the present invention, a gas turbine has at least one of the vane of any one of the first to sixth aspects of the present invention, and the ring segment of the seventh aspect of the present invention.

The gas turbine thus constructed is capable of limiting an increase in the amount of air leakage and limiting heat stress in the shroud body and the ring segment body. Thus, it is possible to improve the performance and the reliability of the gas turbine.

According to a ninth aspect of the present invention, a remodeling method is a method for remodeling a vane supported in a casing by a vane support member. The vane has an airfoil section extending in a radial direction, and an outer shroud arranged on the radially outward side of the airfoil section. The outer shroud has a hook section and a shroud body. The hook section has a radial protrusion, and an engaging part. The shroud body extends in an axial direction and a circumferential direction. The radial protrusion is provided on the radially outward side of the shroud body, protrudes toward the radially outward side, and extends in the circumferential direction. The engaging part protrudes in the axial direction from the radial protrusion and extends in the circumferential direction. The remodeling method for the vane has a step of forming a recessed part recessed in the axial direction or the radial direction, in at least a part of the hook section in the circumferential direction, so as to form a sealing surface which contacts the vane support member in the radial direction along the entire circumference of the engaging part.

The method having the above step is capable of forming a recessed part in an existing vane, while the turbine is being maintained, so as to reduce the amount of air leakage and to relax heat stress.

According to a tenth aspect of the present invention, a remodeling method is a method for a ring segment of a gas turbine which is supported in a casing by a ring segment support member and delimits an outer circumference of an annular high-temperature gas passage. The ring segment has a hook section and a ring segment body. The hook section has a radial protrusion, and an engaging part. The ring segment body extends in an axial direction and a circumferential direction. The radial protrusion is provided on the radially outward side of the ring segment body, protrudes toward the radially outward side, and extends in the circumferential direction. The engaging part protrudes in the axial direction from the radial protrusion and extends in the circumference direction. The remodeling method for the ring segment includes a step of forming a recessed part recessed in the axial direction or the radial direction, in at least a part of the hook section in the circumference direction, so as to form a sealing surface which contacts the ring segment support member in the radial direction continuously along the entire circumference of the engaging part.

Effects of the Invention

The above-described vane, gas turbine, ring segment, remodeling method for a vane, and remodeling method for a ring segment are capable of limiting an increase in amount of air leakage and of relaxing heat stress.

DESCRIPTION OF EMBODIMENTS

First Embodiment

Hereinafter, a vane, a gas turbine, a ring segment, a remodeling method for a vane, and a remodeling method for a ring segment according to a first embodiment of the present invention will be described.

Figure 1:
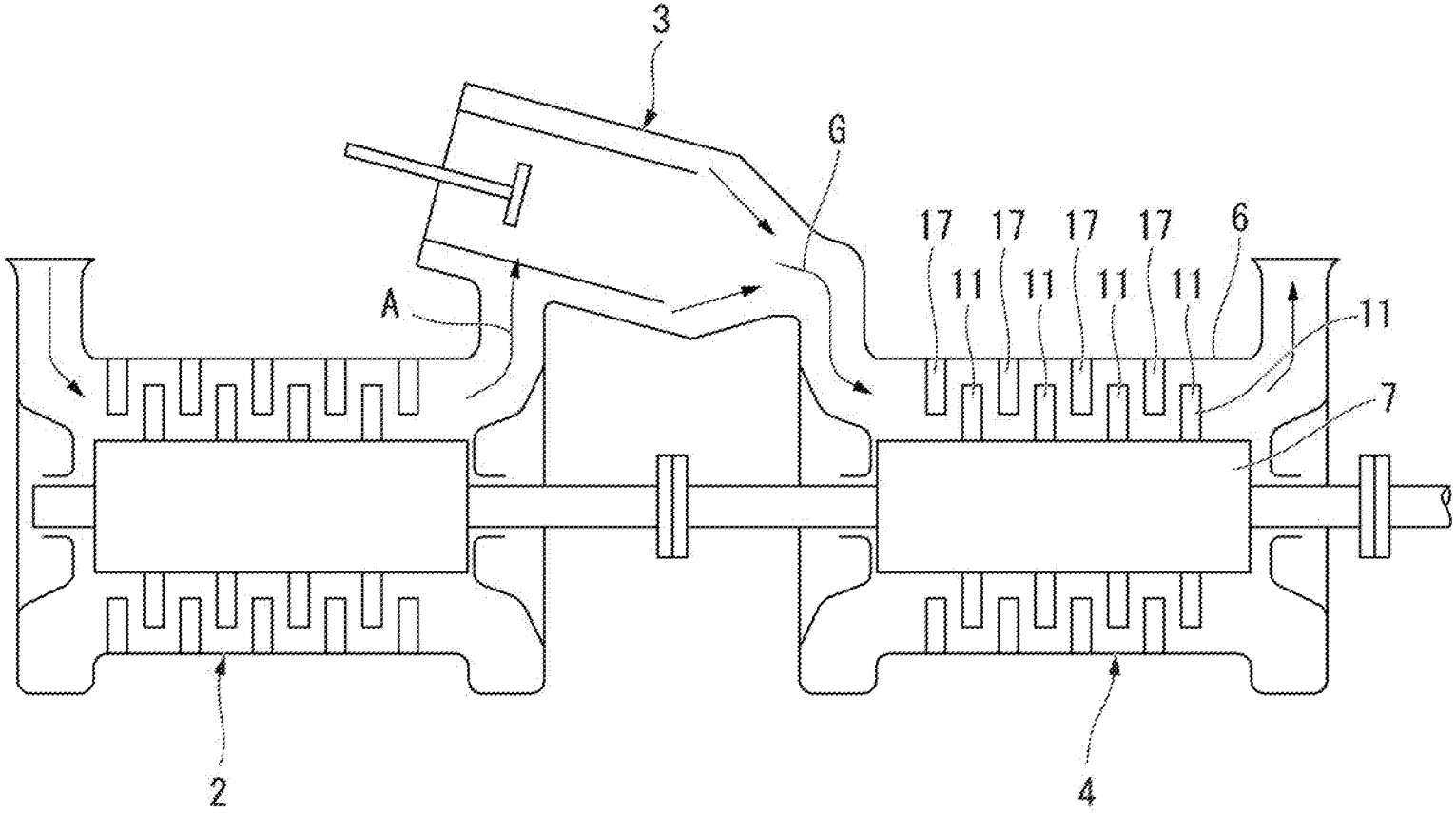
FIG. 1 is a sectional view showing an outline or a gas turbine in a first embodiment of the present invention.
Figure 2:
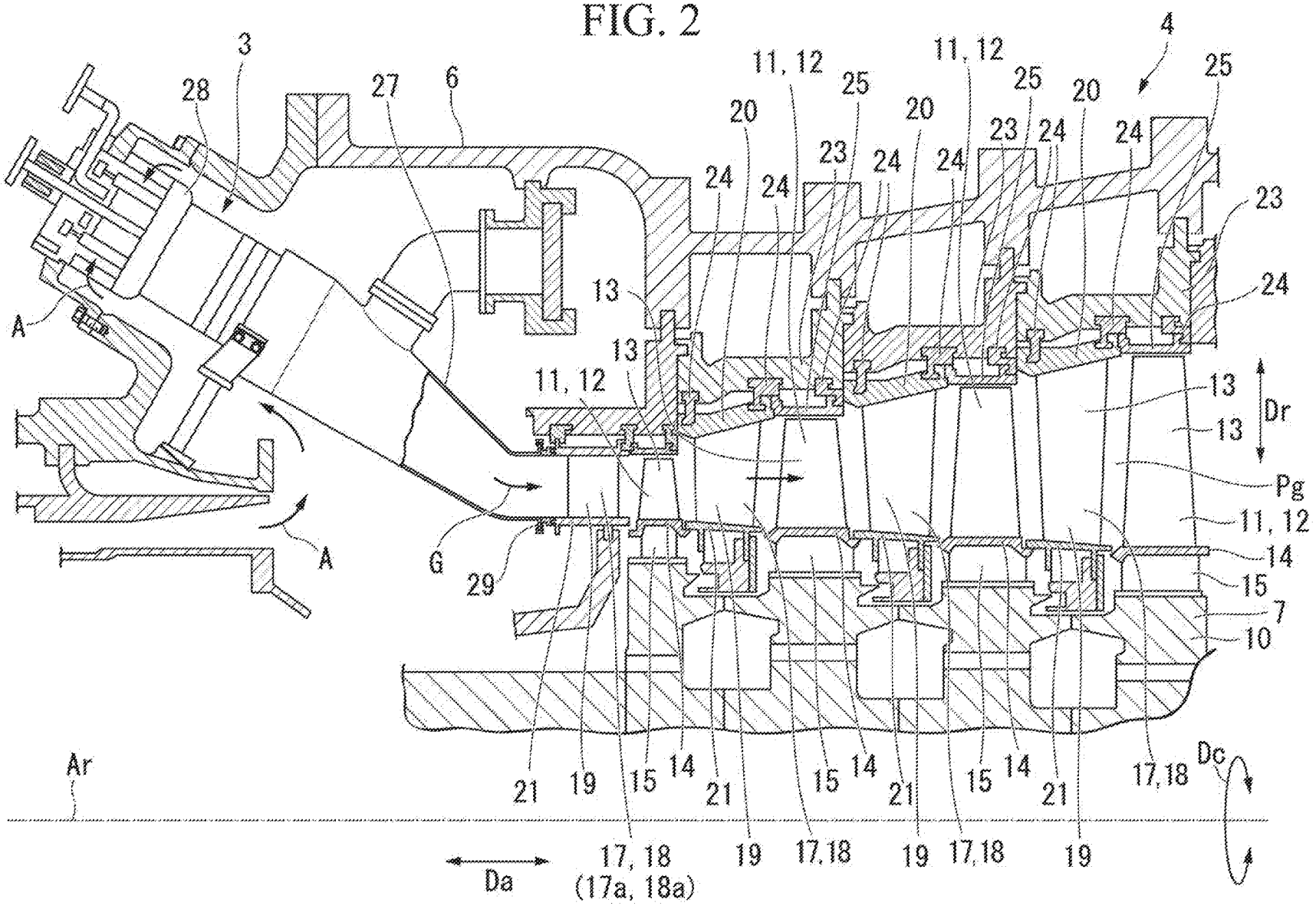
FIG. 2 is a sectional view of a major section of the gas turbine in the first embodiment of the present invention.

FIG. 1 is a sectional view showing an outline of the gas turbine in the first embodiment of the present invention. FIG. 2 is a sectional view of a major section of the gas turbine in the first embodiment of the present invention.

As indicated in FIG. 1, the gas turbine 1 in the first embodiment is provided with a compressor 2, a combustor 3, and a turbine section 4.

The compressor 2 draws in air through an air inlet and compresses it into compressed air.

The combustor 3 is connected with an outlet of the compressor 2. The combustor 3 injects fuel to the compressed air exhausted from the compressor 2 and generates combustion gas G having a high temperature and high pressure.

The turbine section 4 is provided with a casing 6 and a rotor 7.

The casing 6 has a form of cylinder around a rotor axis Ar (shown in FIG. 2).

The rotor 7 is supported by the casing 6 so as to be rotatable around the rotor axis Ar.

The turbine section 4 drives the rotor 7 to rotate by using the combustion gas sent from the combustor 3 as a working fluid. The driving force thus generated in the turbine section 4 is transferred to a generator (not shown in the figures) coupled to the rotor 7. In the following description, "upstream side" means the side of the rotor axis Ar of the turbine section 4 which is toward the compressor 2, and "downstream side" means the other side of the rotor axis Ar opposite to the upstream side. Further, "axial direction Da" means a direction in which the rotor axis Ar extends, "circumferential direction Dc" means a direction of the circumference of the rotor axis Ar, and "radial direction Dr" means a direction radial to the rotor axis Ar. Further, "radially inward" means one side approaching the rotor a Ar in the radial direction Dr, and "radially outward" means the other side leaving from the rotor axis Ar.

As indicated in FIG. 2, the rotor 7 is provided with a rotor body 10 and a plurality of blade stages 11. The rotor 7 extends in the axial direction Da around the rotor axis Ar. The blade stages 11 are aligned in the axial direction Da and mounted on the rotor body 10. Each of the blade stages 11 is provided with a plurality of blades 12. The plurality of blades 12 are aligned in the circumferential direction D relative to the rotor axis Ar and mounted around the rotor axis Ar.

The blade 12 is provided with a blade body 13, a platform 14 and a blade root 15. The blade body 13 extends in the radial direction Dr. The platform 14 is provided on the radially inward sick of the blade body 13. The blade root 15 is provided on the radially inward side of the platform 14. The blade 12 is fixed to the rotor body 10 by inserting the blade root 15 to the rotor body 10.

A vane stage 17 is arranged on the upstream side of each of the plurality of blade stages 11. Each of the vane stages 17 is provided with a plurality of vanes 18. The plurality of vanes 18 are aligned in the circumferential direction Dc. The vane 18 is provided with a vane body (airfoil section) 19, an outer shroud 20, and an inner shroud 21. The vane body 19 extends in the radial direction Dr. The outer shroud 20 is provided on the radially outward side of the vane body 19. The inner shroud 21 is provided on the radially inward side of the vane body 19.

A blade ring 23 is arranged on the radially outward side of the blade stage 11 and the vane stage 17 and radially inward side of the casing 6. The blade ring 23 has a cylindrical form around the rotor axis Ar. The blade ring 23 is fixed to the casing 6. The vane ring 23 is connected to the outer shroud 20 of the vane 18 by an insulation ring 24 serving as a vane support member.

A ring segment 25 is arranged between the outer shrouds 20 next to each other in the axial direction Da. The plurality of ring segments 25 are aligned in the circumferential direction Dc around the rotor axis Ar. The plurality of ring segments 25 aligned in the circumferential direction Dc form an annular shape. The blade stage 11 is arranged on the radially inward side of the ring segments 25. All the plurality of ring segments 25 aligned in the circumferential direction Dc are connected to the blade ring 23 by the insulation ring 24.

The combustor 3 has a transition piece 27 and a fuel supplier 28. The transition piece 27 sends the high-pressure and high-temperature combustion gas G to the turbine section 4. The fuel supplier 28 supplies fuel and compressed air to the transition piece 27. An outlet flange 29 on the downstream side of the transition piece 27 is connected with the inner shroud 21 and the outer shroud 20 of vanes 18*a* composing a first vane stage 17*a*.

The compressed air A flows from the compressor 2 into the casing 6 of the turbine section 4 and further flows into the fuel supplier 28 of the combustor 3 through the circumferential area of the combustor 3. The fuel supplier 28 supplies the feel from the outside to the transition piece 27 together with the compressed air A. The fuel is burned in the transition piece 27 to generate the combustion gas G. The combustion gas G passes between the inner shrouds 21 and the outer shrouds 20 of the plurality of vanes 18 composing the vane stages 17, and between the platforms 14 of the plurality of blades 12 composing the blade stage 11 located on the downstream side of the vane stage 17, and the ring segments 25 arranged on the radially outward side of the blades 12. The combustion gas G rotates the rotor 7 around the rotor axis Ar by contacting the blade body 13 in the above passing process.

An annular combustion gas passage Pg through which the combustion gas G flows is delimited by the outer shroud 20 and the inner shroud 21 of the vane 18, the platform 14 of the blade 12, and the ring segment 25 facing the platform 14.

The vane 18, the blade 12, and the ring segment 25 contact the combustion gas G having high temperature and high pressure, and therefore, work as hot parts.

A part of the above compressed air A or compressed air. A bled from the compressor 2 flows into an area on the radially outward side of the outer shroud 20 and an area on the radially inward side of the inner shroud 21 so as to cool the outer shroud 20 and the inner shroud 21 of the vane 18. A pan of the above compressed air A flowing into the casing 6 from the compressor 2 or the compressed air A bled from the compressor 2 is also supplied to an area on the radially inward side of the casing 6 and radially outward side of the blade ring 23. The compressed air A flows into the radially outward side of the ring segment 25 through the blade ring 23 so as to cool the ring segment 25 arranged on the radially inward side of the blade ring 23.

Figure 3:
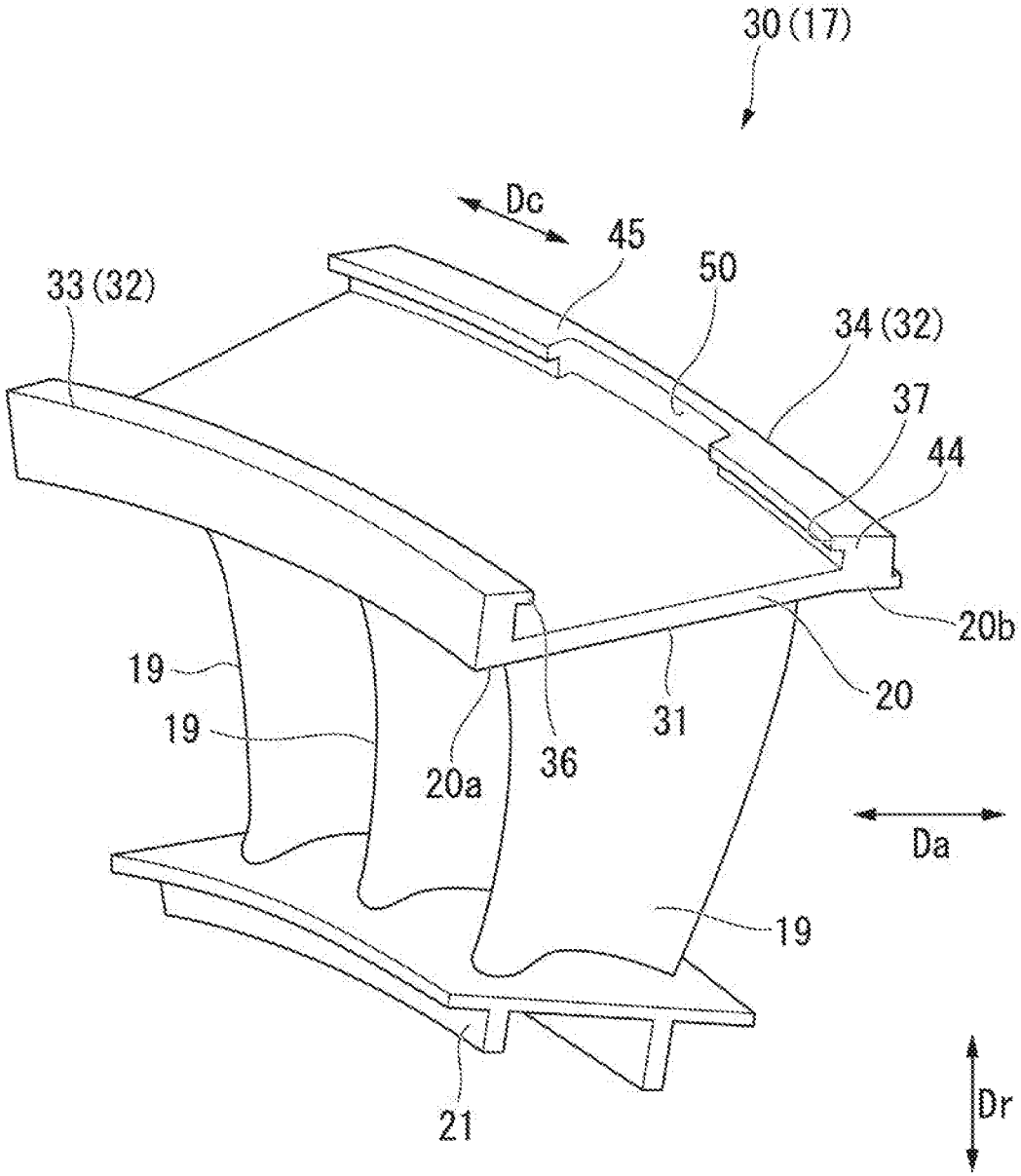
FIG. 3 is a perspective view of a vane segment in the first embodiment of the present invention.
Figure 4:
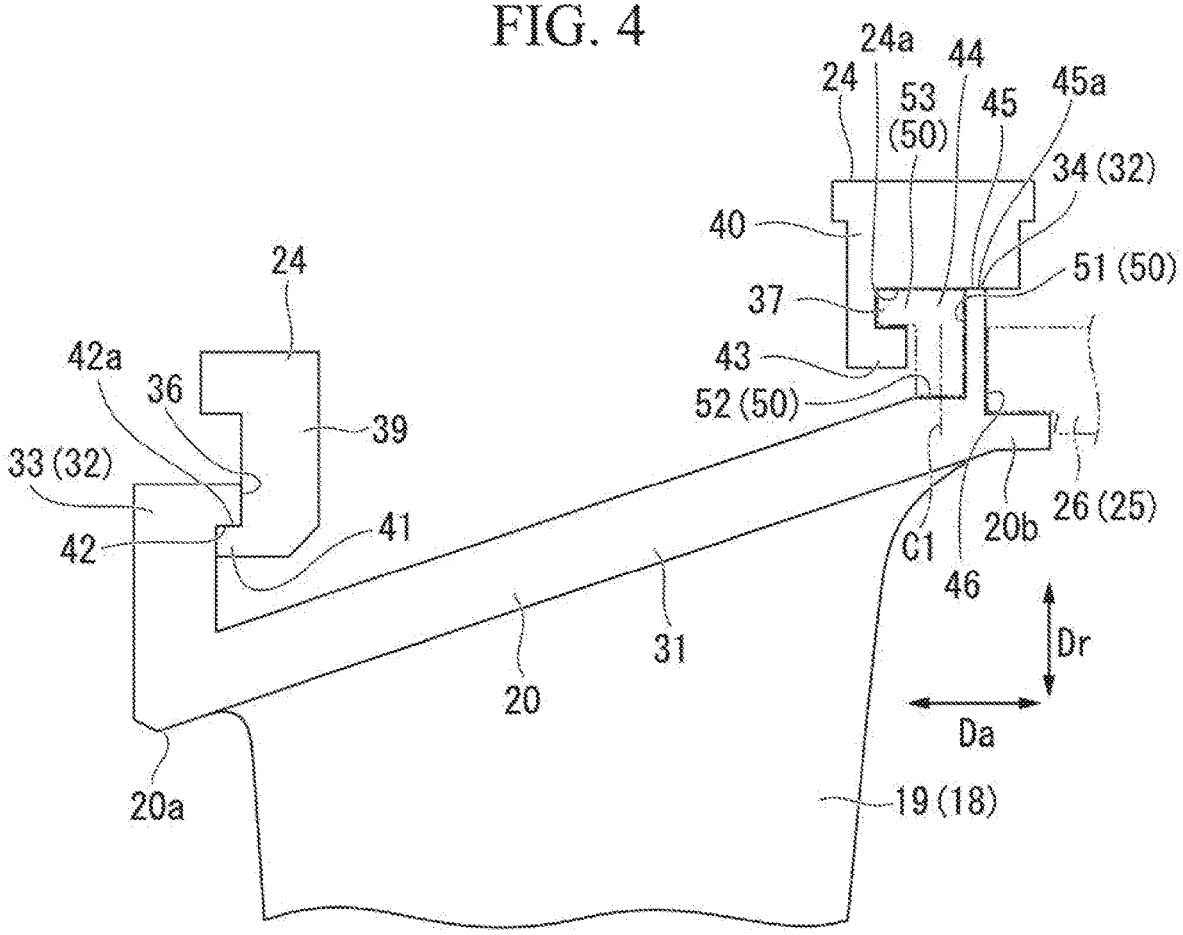
FIG. 4 is a sectional view of an outer shroud in the first embodiment of the present invention.

FIG. 3 is a perspective view of a vane segment in the first embodiment of the present invention. FIG. 4 is a sectional view, from the circumferential direction, of a part around the outer shroud 20 in the first embodiment of the present invention.

As indicated in FIG. 3, the vane stage 17 has a plurality of vane segments 30. The vane stage 17 has the plurality of vane segments 30 aligned in the circumferential direction Dc and connected to each other so as to form an annular shape. The vane segment 30 in the first embodiment has three vane bodies 19, the outer shroud 20, and the inner shroud 21. These vane bodies 19, outer shroud 20, and inner shroud 21 are formed integrally.

The outer shroud 20 has a shroud body 31 and a hook section 32.

The shroud body 31 extends in the axial direction Da and the circumferential direction Dc. The shroud body 31 has a shape of board curving in the circumferential direction Dc. The shroud body 31 has the vane bodies 19 extending from the inner circumferential surface of the shroud body 31 to the radially inward side.

The hook section 32 is formed so as to engage the vane segment 30 with the insulation ring 24. The hook section 32 has a front hook 33 and a rear hook 34.

As indicated in FIGS. 3 and 4, the front hook 33 is arranged on the upstream side nearby a peripheral end 20*a* of the outer shroud 20 in the axial direction Da. The front hook 33 in the first embodiment is arranged at the peripheral end 20*a* on the upstream side of the outer shroud 20. The front hook 33 protrudes to the radially outward side from the shroud body 31 of the outer shroud 20. The front hook 33 is formed continuously over the entire width of the outer shroud 20 in the circumferential direction Dc.

The front hook 33 has a protrusion 36 protruding to the downstream side in the axial direction Da. The protrusion 36 protrudes from a radially outer end of the front hook 33.

The rear hook 34 is arranged on the downstream side in the axial direction Da nearby a peripheral end 20*b* of the outer shroud 20. The rear hook 34 in the first embodiment is arranged at the peripheral end 20*b* on the downstream side of the outer shroud 20. The rear hook 34, like the front hook 33, protrudes to the radially outward side from the shroud body 31 of the outer shroud 20. The rear hook 34 is formed continuously over the entire width of the outer shroud 20 in the circumferential direction Dc. The rear hook 34 has a protrusion 37 protruding toward the upstream side in the axial direction Da.

As indicated in FIG. 4, the insulation ring 24 has a front engaging part 39 to engage with the front hook 33. The engaging pan 39 extends toward the radially inward side so as to be located next to the downstream side of the front hook 33. The front engaging part 39 has a supporting section 41. The supporting section 41 supports the protrusion 36 in the front hook 33 from the radially inward side. The supporting section 41 extends from the downstream side to the upstream side in the axial direction Da. The supporting section 41 is formed continuously in the circumferential direction Dc in the same way as the front hook 33.

Since the vane 18 is pressed by the combustion gas G flowing from the upstream to the downstream, a three trying to shift the front hook 33 to the radially inward side acts on the front hook 33. As a result, a radially inward face of the protrusion 36 in the front hook 33 is pressed against a radially outward face of the supporting section 41 in the insulation ring 24. By this action, a gap 42*a* between the radially inward face of the protrusion 36 and the radially outward face of the supporting section 41 narrows.

The cross-sectional area of the gap 42*a* is the narrowest in a passage between the insulation ring 24 and the front hook 33 through which cooling air leaks to the combustion gas passage Pg (shown in FIG. 2). In other cords, the face of the protrusion 36 of the front hook 33 directed radially inward serves as a sealing surface 42 which continues in the circumferential direction Dc.

The insulation ring 24 has a rear engaging part 40 which engages with the rear hook 34. The rear engaging part 40 extends to the radially inward side so as to be located next to the upstream side of the rear hook 34. The rear engaging part 40 has a supporting section 43 supporting the protrusion 37 of the rear hook 34 from the radially inward side. The supporting section 43 extends from the upstream side to the downstream side in the axial direction Da. The supporting section 34 is formed continuously in the circumferential direction Dc in the same way as the rear hook 34.

When the combustion gas G flowing from the upstream to the downstream presses the vane 18, a force trying to shin the rear hook 34 toward the radially outward side acts on the rear hook 34. By the action of the three, a radially outward face of the protrusion 37 in the rear hook 34 is pressed against a surface of a radially inward face 24*a* of the insulation ring 24. By this action, a gap 45*a* between the radially outward face of the protrusion 37 and the radially inward the 24*a* of the insulation dug 24 narrows. The cross-sectional area of the gap 45*a* is the narrowest in a passage between the insulation ring 24 and the rear hook 34 through which cooling air leaks to the combustion gas passage Pg (shown in FIG. 2). In other words, the face of the rear hook 34 directed radially outward serves as a sealing surface 45 continuing in the circumferential direction Dc.

The rear hook 34 has the sealing surface 45 that is the face directed to the radially outward side, i.e., both of the face directed to the radially outward side of a hook body 44 which rises toward the radially outward side, and the face directed to the radially outward side of the protrusion 37. In the first embodiment, the face directed toward the radially outward side of the hook body 44 and the face directed toward the radially outward side of the protrusion 37 form the unitary sealing surface 45 which continues in the circumferential direction Dc.

Each of the sealing surfaces 42, 45 limits leakage of the cooling air, which is supplied to the radially outward side of the outer shroud 20, to the combustion gas passage Pa on the radially inward side of the outer shroud 20.

Figure 5:
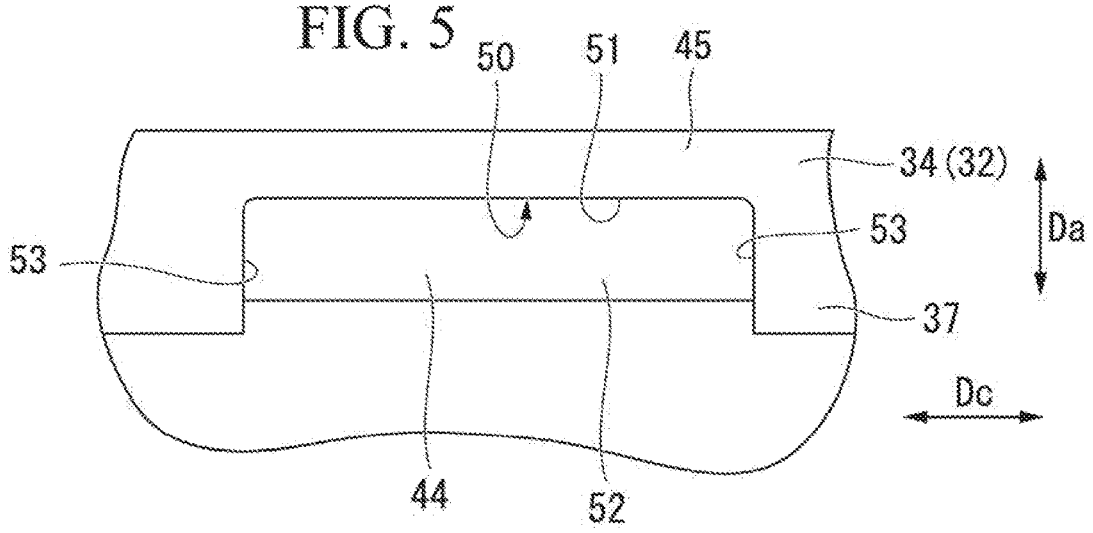
FIG. 5 is a view of a recessed part from a radially outward-side point of view in the first embodiment of the present invention.
Figure 6:
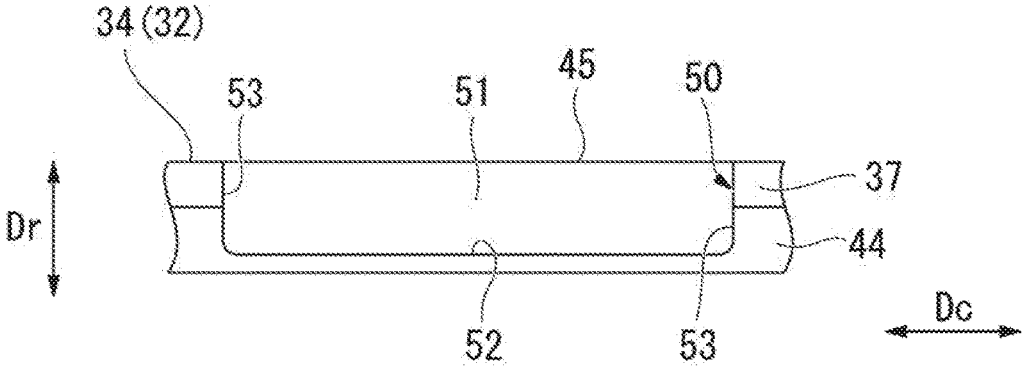
FIG. 6 is a view of the recessed part from an axially upstream-side point of view in the first embodiment of the present invention.

FIG. 5 is a view of a recessed part from a radially outward-side point of view in the first embodiment of the present invention. FIG. 6 is a view of the recessed part from an axially upstream-side point of view in the first embodiment of the present invention.

As indicated in FIG. 3 to FIG. 6, the rear hook 34 has a recessed part 50. The recessed part 50 is formed in at least a part of the rear hook 34 in the circumferential direction Dc. The sealing surface 45 is formed on a face of the rear hook 34 directed to the radially outward side. The recessed part 50 is formed by removing a part of the sealing surface 45. However, the sealing surface 45 is formed continuously in the circumferential direction Dc over the entire width of the rear hook 34 including a downstream part of the recessed part 50 in the axial direction Da.

The recessed part 50 in the first embodiment is formed in a central part in the circumferential direction Da of the vane segment 30. In other words, the recessed part 50 is formed in a part including the center in the circumferential direction Dc of the hook section 32. The recessed part 50 in the first embodiment is formed in the rear hook 34 so as to be recessed from the upstream side to the downstream side in the axial direction Da. More specifically, when seen along the axial direction Da, the recessed part 50 extends from the side of the protrusion 37 to the hook body 44 and is recessed to such an extent as not to penetrate to the downstream side of the hook body 44 in the axial direction Da. A face 51 of the recessed part 50 directed to the downstream side is located between a central part C1 (shown in FIG. 4) of the hook body 44 and a second protrusion 38 in the axial direction Da.

The recessed part 50 has the face 51 directed to the downstream side, a face 52 directed to the radially inward side, and faces 53 located on both sides of the recessed part 50 in the circumferential direction Dc. The face 51 directed to the downstream side extends in the radial direction Dr and also in the circumferential direction Dc. The face 52 directed to the radially inward side extends in the axial direction Da and also in the circumferential direction Dc. The faces 53 directed to both sides in the circumferential direction Dc extend in the radial direction Dr and also in the axial direction Da. Corners where the face 51 directed to the downstream side, the face 52 directed to the radially inward side, and the faces 53 arranged on both sides in the circumferential direction Dc are connected to one another have a curved surface.

Next, a remodeling method for the vane 18 in the gas turbine 1 of the first embodiment will be described with reference to the figures. The method of the first embodiment is a remodeling method for a gas turbine which is an existing gas turbine. A remodeling method for the ring segment 25 described later is similar to the following remodeling method for the vane. Therefore, a specific description of the remodeling method for the ring segment 25 will be omitted.

Figure 7:
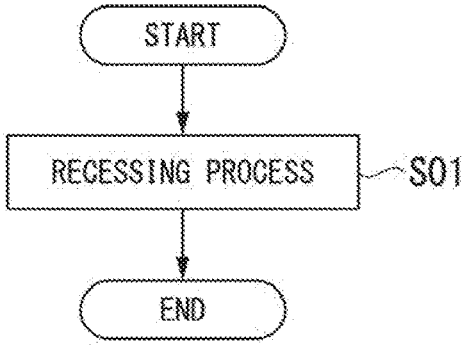
FIG. 7 is a flow chart showing a remodeling method for a vane in the first embodiment of the present invention.

FIG. 7 is a flow chart of the remodeling method for a vane in the first embodiment of the present invention.

Firstly, as a preparing process, the vane 18 is removed from the insulation ring 24.

Secondly, as indicated in FIG. 7, a working process, for instance a cutting work process, is performed on the hook section 32 of the vane 18 to form the recessed part 50 (step S01; recessed part forming process).

Next, as a finishing process, the vane 18 is assembled to the insulation ring 24 in reversed processing order of removing the hook section 32 from the insulation ring 24. The remodeling method for the vane 18 is completed by the above processing.

In the first embodiment, the stiffness of the rear hook 34 in the hook section 32 can be reduced by the recessed part 50. Therefore, the rear hook 34 can deform following a deformation of the shroud body 31 by heating. The hook section 32 has the recessed part 50 recessed in the axial direction or the radial direction, and yet the sealing surface 45 of the protrusion 37 is not split by the recessed part 50 in the circumferential direction Dc. Thus, the vane in the first embodiment can limit an increase in the amount of air leakage and extend the lifetime of the vane 18 by relaxing the heat stress acting on the vane 18.

Further, since the vanes 18 comprise the plurality of vane segments 30, the recessed part 50 can be easily formed at each of the plurality of vane segments 30. As a result, the stiffness of the rear hook 34 can be easily reduced.

Further, the vane in the first embodiment can limit the heat stress on the shroud body 31 while limiting an increase in the amount of air leakage. Therefore, the performance and the reliability of the gas turbine can be improved.

Second Embodiment

Next, a vane in a second embodiment of the present invention will be described. The vane of the second embodiment has a further recessed part in the front hook 33 of the vane in the first embodiment. Therefore, the same reference numbers are used for the components of the following second embodiment which are equivalent to those of the first embodiment, and repeated description for the equivalent components are omitted.

Figure 8:
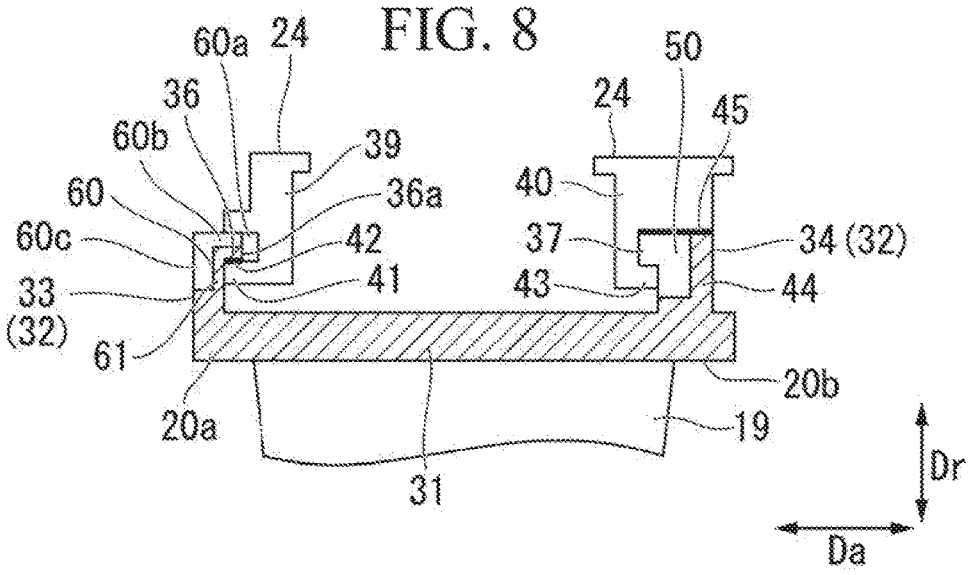
FIG. 8 is a sectional view of an outer shroud in a second embodiment of the present invention corresponding to the section as shown in FIG. 4.

FIG. 8 is a sectional view of an outer shroud in the second embodiment of the present invention corresponding to the section as shown in FIG. 4. As indicated in FIG. 8, the front hook 33 is provided on the upstream side in the axial direction Da nearby the peripheral end 20*a* of the outer shroud 20. The front hook 33 has the protrusion 36 protruding to the downstream side in the axial direction Da. The sealing surface 45 (indicated by a bold line in FIG. 8) the rear hook 34 is directed to the radially outward side. The protrusion 36 of the front hook 33 has the sealing surface 42 (indicated by a bold line in FIG. 8) which is the face on the radially inward side so as to seal a gap between the insulation ring 24 and the front hook 33.

The front hook 33 has a recessed part 60. The recessed part 60 is formed in at least a part of the front hook 33 in the circumferential direction Dc. The recessed part 60 has the sealing surface 42 over at least a part thereof in the axial direction Da. The recessed part 60 is formed in the front hook 33 so as to be recessed in the axial direction Da.

More specifically, the recessed part 60 has a shape curved from a part 60*a* an the downstream side of the sealing surface 42 in the protrusion 36 in the axial direction Da, via a part 60*b* the radially outward side of the hook body 61, to a part 60*c* on the upstream side of the hook body 61 in the axial direction Da. In other words, the recessed part 60 is arranged in the axial direction Da relative to the sealing surface 42 at the part 60*a* on the downstream side of the sealing surface 42 in the axial direction Da and also at the part 60*c* on the upstream side of the hook body 61 in the axial direction Da. The part 60*c* on the upstream side of the recessed part 60 is located further upstream in the axial direction Da than an end face 36*a* of the protrusion 36 across the seating surface 42.

According to the second embodiment, the stiffness of the front hook 33 can be reduced by the recessed part 60. Thus, the recessed part 60 is capable of reducing the heat stress on the upstream side in the axial direction Da of the shroud body 31.

Since the sealing surface 42 is formed continuously in the circumferential direction Dc over the entire width of the front hook 33, the performance of sealing between the front engaging part 39 and the front hook 33 is secured. As a result, reduction of the stiffness of the front hook 33 thus performed does not cause an increase in the amount of air leakage.

The recessed parts 60 formed on both of the upstream side and the downstream side of the sealing surface 42 in the axial direction Da are capable of sufficiently reducing the stiffness of the front hook 33. As a result, the heat stress acting on the upstream side in the axial direction Da of the shroud body 31 can be sufficiently reduced.

First Variation

Figure 9:
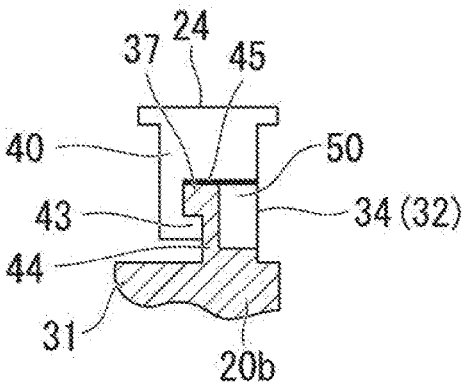
FIG. 9 is a sectional view of a rear hook in a first variation of the embodiments of the present invention.

FIG. 9 is a sectional view of a rear hook in a first variation of the embodiments of the present invention.

In the above embodiments, an example of forming the recessed part 50 on the upstream side in the axial direction Da of the sealing surface 45 in the rear hook 34 has been described. However, the sealing surface 45 can be arranged in various areas in the axial direction Da relative to the recessed part 50. For instance, as indicated in FIG. 9, the recessed part 50 can be formed on the downstream side in the axial direction Da of the sealing surface 45.

Second Variation

Figure 10:
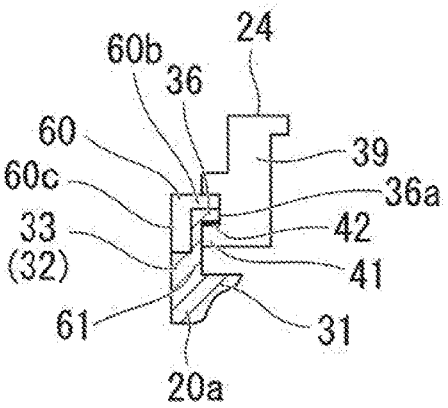
FIG. 10 is a sectional view of a front hook in a second variation of the embodiments of the present invention.

FIG. 10 is a sectional view of a front hook in a second variation of the embodiments of the present invention.

In the above second embodiment, an example of forming the recessed part 60 on the upstream side and also on the downstream side in the axial direction Da of the sealing surface 42 in the front hook 33 has been described. Alternatively, however, the recessed part 60 can be formed on one of the upstream side and the downstream side of the sealing surface 42. For instance, as indicated in FIG. 10, a recessed part 60 may be formed so as to extend from a part 10*b* on the radially outward side of a hook body 61 to a part 60*c* on the upstream side in the axial direction Da of the hook body 61. In other words, the part 60*a* on the downstream side in the axial direction Da of the sealing surface 42 can be omitted.

Third Variation

Figure 11:
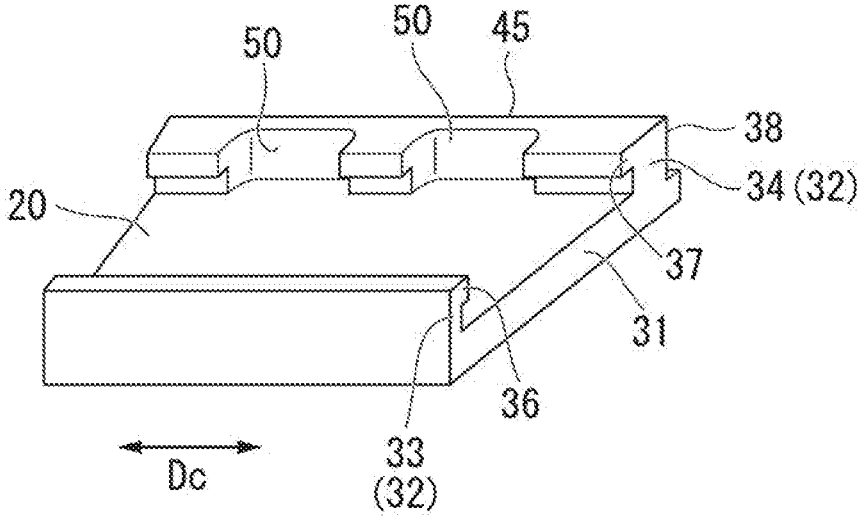
FIG. 11 is a perspective view of an outer shroud in a third variation of the embodiments of the present invention.

FIG. 11 is a perspective view of an outer shroud in a third variation of the embodiments of the present invention. FIG. 11 shows only the outer shroud 20 in a simplified form.

The outer shroud 20 of the vane segment 30 in each of the first and second embodiments has only one recessed pan 50 at the central part in the circumference direction Dc. However, the number and location of the recessed part 50 is not limited to those in the first and second embodiments. For instance, as indicated in the third variation in FIG. 11, a plurality of recessed parts 50 can be formed in the outer shroud 20 in the circumferential direction Dc. The number of the recessed parts 50 is not limited to two, and therefore, three or the more recessed pans 50 may be provided. Since it is possible to further lower the stiffness of the hook section 32 by thus increasing the number of the recessed parts 50, the stiffness of the hook section 32 cam be adjusted easily. The third variation discloses the hook section 32 having a plurality of recessed parts 50. Similarly, a plurality of recessed parts 60 also can be formed in the hook section 32.

Fourth Variation

Figure 12:
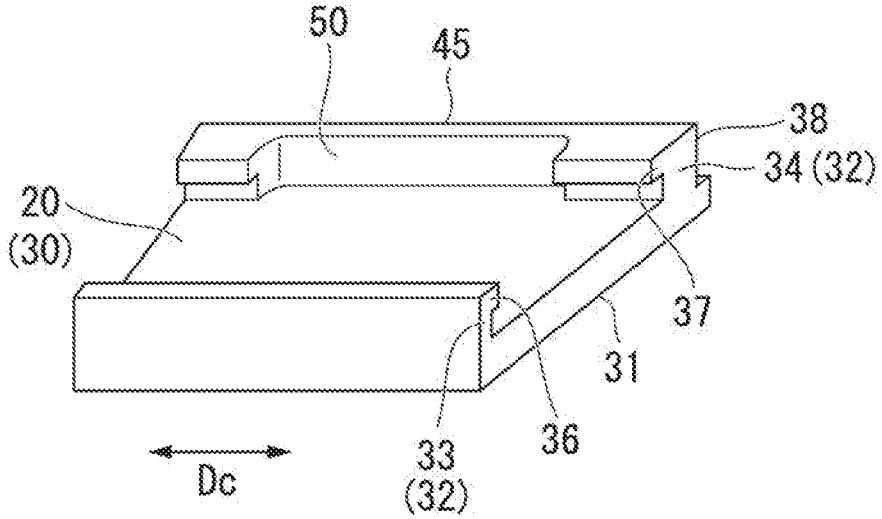
FIG. 12 is a perspective view of an outer shroud in a fourth variation of the embodiments of the present invention.

FIG. 12 is a perspective view of an outer shroud in a fourth variation of the first and second embodiments of the present invention. FIG. 12 shows only the outer shroud in a simplified form.

The outer shroud 20 of the vane segment 30 in each of the first and second embodiments has the recessed part 50 in a part of the rear hook 34 in the circumferential direction Dc. However, the construction of the recessed part 50 is not limited to that in the first and second embodiments. For instance, as indicated in the fourth variation in FIG. 12, the length of a recessed part 50 can be more than half of a length of the vane segment 30 in the circumferential direction Dc. In other words, the recessed part 50 can be formed in a major part of the vane segment 30 in the circumferential direction Dc. According to the construction above, it is possible to further lower the stiffness of the hook section 32, as in the case of the hook section 32 having a plurality of the recessed part 50 in one vane segment 30, while reducing the number of cutting processes etc. Thus, the stiffness of the hook section 32 can be adjusted easily. The fourth variation discloses the hook section 32 having the longer recessed part 50. Similarly, a longer recessed part 60 also can be formed in the hook section 32.

The present invention is not limited to the embodiments and the variations, but includes various changes to the above embodiments and variations unless such changes depart from the scope of the present invention. In other words, the specific shapes, configurations, etc. described in the embodiments and the variations are just examples and can be modified as appropriate.

For instance, the shape of the recessed part 50 is not limited to the shape described in the first embodiment as far as the shape is effective in reducing the stiffness of the hook section 32.

Figure 13:
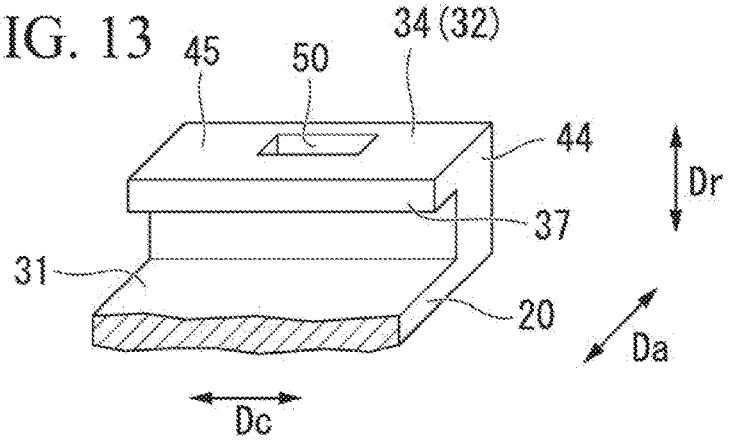
FIG. 13 is an expanded perspective view of a part around a rear hook in a filth variation of the embodiments of the present invention.
Figure 14:
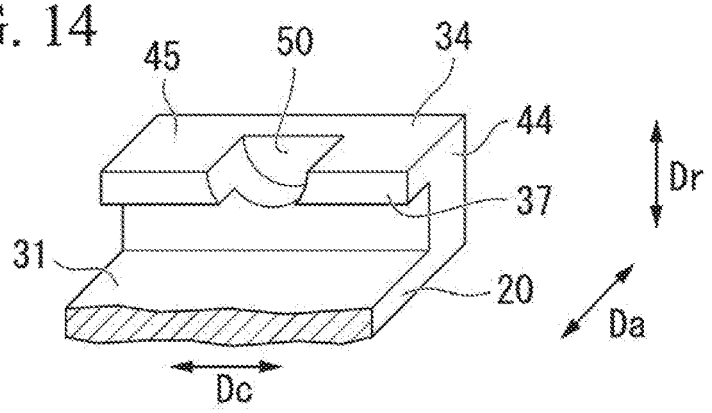
FIG. 14 is an expanded perspective view of an area around a rear hook in a sixth variation of the embodiments of the present invention.

FIG. 13 is an expanded perspective view of an area around a rear hook in a fifth variation of the embodiments of the present invention. FIG. 14 is an expanded perspective view of a part around a rear hook in a sixth variation of the embodiments of the present invention.

In the first and second embodiments, the structure in which the recessed part 50 is formed in the rear hook 34 so as to be recessed from the upstream side to the downstream side in the axial direction Da has been described. However, the shape of the recessed part 50 is not limited to that in the embodiments. For instance, a recessed part 50 may be formed so as to be recessed in the radial direction Dr as in the fifth variation shown in FIG. 13.

In the above embodiments, the recessed part 50 has the shape of an angular groove when seen in a cross-section perpendicular to the axial direction Da. However, the shape of the recessed part 50 is not limited to this shape, and other shapes which can reduce the stiffness of the hook section 32 can be adopted for the recessed part 50. For instance, as in the sixth variation indicated in FIG. 14, a recessed part 50 shaped as a round groove when seen in a cross-section perpendicular to the axial direction Da may also be formed.

Figure 15:
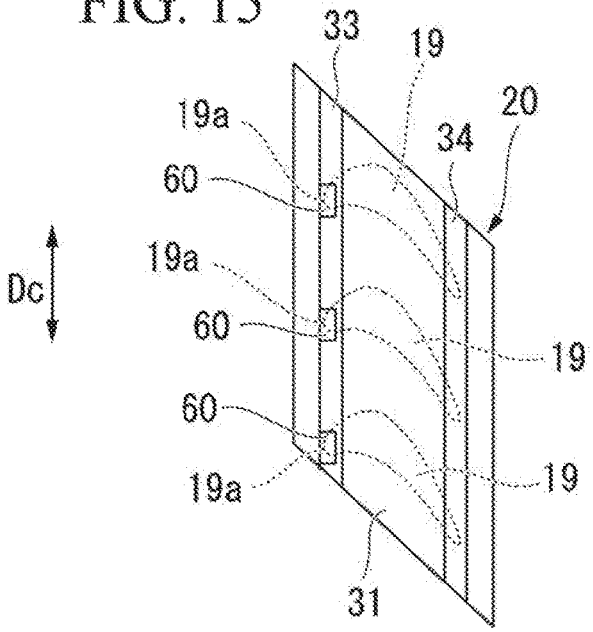
FIG. 15 is a view, from a radially outward side, of an outer shroud in a seventh variation of the embodiments of the present invention.
Figure 16:
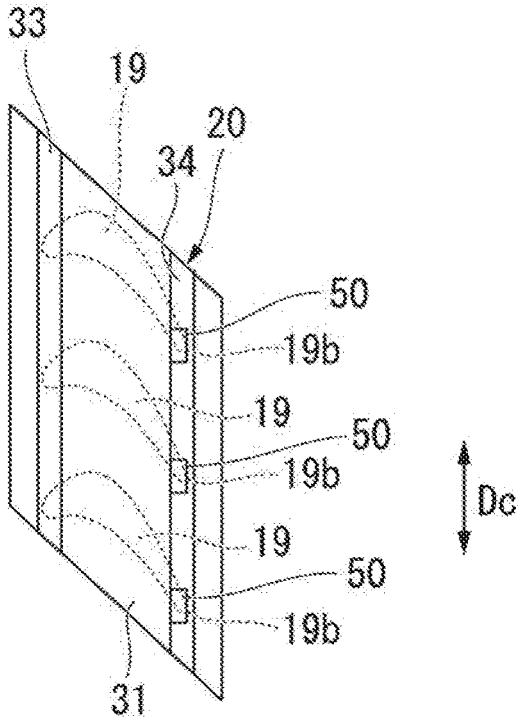
FIG. 16 is a view, from a radially outward side, of an outer shroud in an eighth variation of the embodiments of the present invention.
Figure 17:
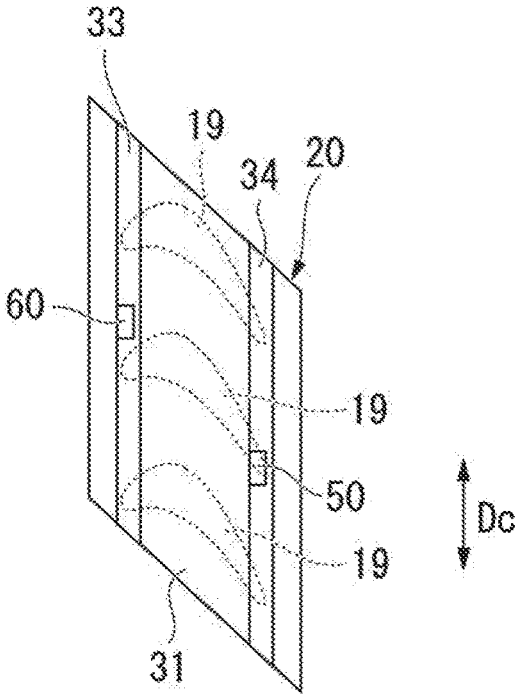
FIG. 17 is a view, from a radially outward side, of the outer shroud in the first embodiment of the present invention.

FIG. 15 is a view, from a radially outward side, of an outer shroud in a seventh variation of the embodiments of the present invention. FIG. 16 is a view, from a radially outward side, of an outer shroud in an eighth variation of the embodiments of the present invention. FIG. 17 is a view, from the radially outward side, of the outer shroud in the first embodiment of the present invention.

As shown in FIG. 17, in the first embodiment, an example has been described in which each of the recessed parts 50 and 60 is formed in the area including the center in the circumferential direction Dc of the hook section 32. However, the location of the recessed part is not limited to that in the above embodiments. For instance, as in the seventh variation in FIG. 15, a plurality of recessed parts 60 may be arranged so that each of the recessed parts 60 includes an area where a leading edge 19*a* of a vane body 19 is located when seen in the circumferential direction Dc. Similarly, as in the eighth variation in FIG. 16, a plurality of recessed parts 50 may be arranged so that each of the recessed parts 50 includes an area where a trailing edge 19*b* of a vane body 19 is located when seen in the circumferential direction Dc.

A connection area where the shroud body 31 is connected with the leading edge 19*a* of the vane body 19 and a connection area where the shroud body 31 is connected with the trailing edge 19*b* each undergoes a deformation of the vane body 19 in addition to deformation of the shroud body 31. Heat stress in these connection areas thus tends to be high. It is possible to efficiently relax the heat stress in these highly-stressed areas by arranging the recessed part 50 in an area where the trailing edge 19*b* of the vane body 19 is located and arranging the recessed part 60 in an area where the leading edge 19*a* of a vane body 19 is located when seen in the circumferential direction Dc. In FIG. 15, only the recessed part 60 is provided, and in FIG. 16, only the recessed part 50 is provided. However, both of the recessed parts 50 and 60 can be provided in the hook sections.

Figure 18:
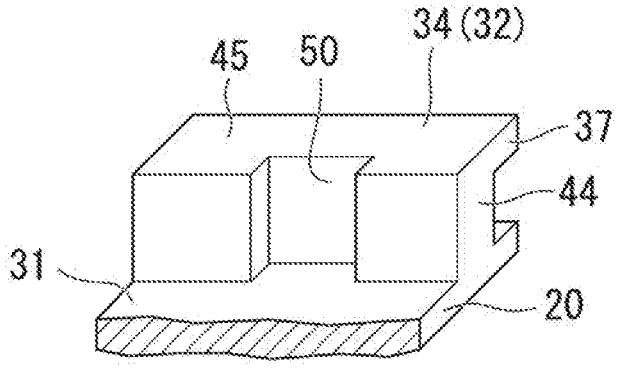
FIG. 18 is an expanded perspective view, corresponding to FIG. 13, of an area around a rear hook in a tenth variation of the embodiments of the present invention.

FIG. 18 is an expanded perspective view, corresponding to FIG. 13, of an area around a rear, hook in a tenth variation of the embodiments of the present invention.

In the above embodiments, the structures in, which the protrusion 37 in the rear hook 34 protrudes toward the upstream side in the axial direction Da have been described. However, the direction in which the protrusion 37 protrudes is not limited to the direction toward the upstream side in the axial direction Da. For instance, as in the tenth variation indicated in FIG. 18, a protrusion which protrudes to the downstream side in the axial direction Da can also be formed. The position of the recessed part 50 is not limited to the position on the upstream side of the rear hook 34 as in the example shown in FIG. 18.

In the second embodiment, the recessed part 60 is formed in the front hook 33 and the recessed part 50 is formed in the rear hook 34. However, for instance, a structure in which a recessed part 60 is formed in a front hook 33 and a recessed part 50 is not provided in a rear hook 34 is also conceivable.

Figure 19:
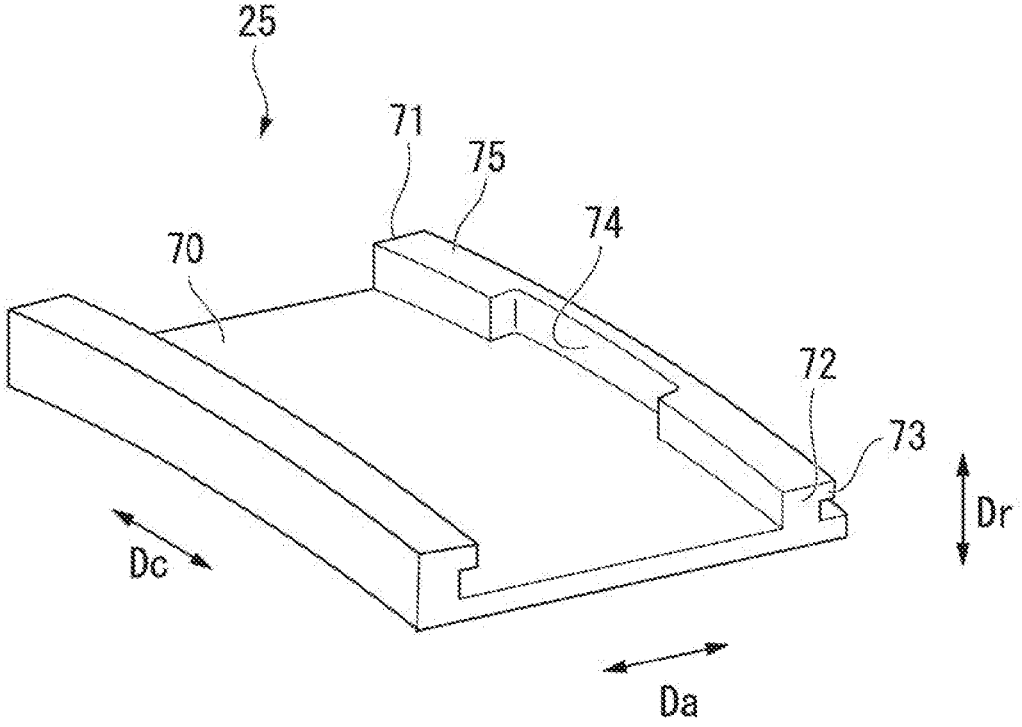
FIG. 19 is a perspective view of a ring segment in an eleventh variation of the embodiments of the present invention.

FIG. 19 is a perspective view of as ring segment in an eleventh variation of the embodiments of the present invention.

In the first and second embodiments, the recessed parts 50 and 60 are formed in the outer shroud 20 of the vane 18. However, recessed parts 50 and 60 can also be employed in the ring segments 25.

As indicated in FIG. 19, the ring segment 25 has a ring segment body 70 and a hook section 71. The ring segment body 70 extends in an axial direction Da and a circumferential direction Dc (shown in FIG. 2).

The hook section 71 has a radial protrusion 72 and an engaging part 73. The radial protrusion 72 is arranged on the outward side of the ring segment body 70 in a radial direction Dr. The radial protrusion 72 protrudes toward the outward side in the radial direction Dr and extends in the circumferential direction Dc. The engaging part 73 protrudes from the radial protrusion 72 toward the downstream side in the axial direction Da and extends in the circumferential direction Dc. The hook section 71 has a recessed part 74, recessed in the axial direction Da or the radial direction Dr, in at least a part of the hook section 71 in the circumferential direction Dc. FIG. 19 indicates an example in which the recessed part 74 is recessed in the axial direction Da. The engaging part 73 has a sealing surface 75 which contacts the insulation ring 24 (ring segment support member; shown in FIG. 2) in the radial direction Dr continuously over the entire engaging part 73 in the circumferential direction Dc.

In the ring segment 25 thus constructed, the recessed part 74 is capable of reducing the stiffness of the hook section 71 in the same manner as the outer shroud 20 in the embodiments. Therefore, the hook section 71 is capable of deforming following a deformation of the ring-segment body 70 due to heating. The recessed part 74 does not split the sealing surface 75 of the radial protrusion 72 in the circumferential direction Dc. Therefore, the scaling surface 75 can be formed continuously in the circumferential direction Dc. As a result, it is possible to limit an increase in the amount of air leakage and relax the heat stress acing on the ring segment body 70 so as to extend the lifetime of the ring segment 25. A variety of shapes and layouts may be adopted for the recessed part 74 of the ring segment 25 as with the recessed parts 50 in the vanes 18 in the above embodiments and variations.

INDUSTRIAL APPLICABILITY

The present invention can be utilized for a vane, a gas turbine, a ring segment, a remodeling method for a vane, and a remodeling method for a ring segment. The present invention is capable of limiting an increase in the amount of air leakage and relaxing heat stress.

REFERENCE SIGNS LIST

1: gas turbine
2: compressor
3: combustor
4: turbine section
6: easing
7: rotor
10: rotor body
11: blade stage
12: blade
13: blade body
14: platform
15: blade root
17: vane stage
18: vane
19: vane body (airfoil section)
19*a*: leading edge
20: outer shroud
20*a*: upstream-side peripheral end
20*b*: downstream-side peripheral end
21: inner shroud
23: blade ring
24: insulation ring (vane support member, ring segment support member)
25: ring segment
26: upstream-side end
27: transition piece
28: fuel supplier
29: outlet flange
30: vane segment
31: shroud body
32: hook section
33: front hook
34: rear hook
36: protrusion
36*a*: end face
37: protrusion
39: front engaging part (engaging part)

40: rear engaging part (engaging part)
41: supporting section
42: sealing surface
43: supporting section
44: hook body
45: gap
50: recessed part
51: downstream-side face
52: radially inward-side face
53: circumferential faces
60: recessed part
60*a*: downstream-side part
60*b*: radially outward-side part
60*c*: upstream-side part
61: hook body
70: ring segment body
71: hook section
72: radial protrusion
73: engaging part
74: recessed part
75: sealing surface
Ar: rotor axis
Pg: combustion gas passage (high-temperature gas passage)
C1: central part

What is claimed is:

1. A vane comprising an airfoil section extending in a radial direction and an outer shroud located on a radially outward side of the airfoil section, and supported inside a casing by a vane support member, the outer shroud comprising:

a shroud body which extends in an axial direction and a circumferential direction; and a hook section which has a radial protrusion provided on the radially outward side of the shroud body, protruding toward the radially outward side, and extending in the circumferential direction, and an engaging part protruding in the axial direction from the radial protrusion and extending in the circumferential direction, wherein the hook section comprises a rear hook arranged on a downstream side of the shroud body in the axial direction, the hook section comprises at least one recessed part recessed in the axial direction or the radial direction in at least a part of the circumference of the hook section and reducing a stiffness of the hook section, the at least one recessed part extends completely through the rear hook, the engaging part comprises a sealing surface which contacts the vane support member in the radial direction continuously along the entire circumference of the engaging part, and the sealing surface is not split by the at least one recessed part in the circumferential direction.

2. The vane according to claim 1, wherein the hook section comprises a front hook, arranged on an upstream side in the axial direction, the engaging part of which has a sealing surface on a radially inward side.

3. The vane according to claim 2, wherein an area of the shroud body in the circumferential direction, in which the at least one recessed part is arranged, includes a position in the circumferential direction of the shroud body at which a leading edge of the airfoil section is arranged.

4. The vane according to claim 1, wherein the engaging part of the rear hook has a sealing surface on a radially outer circumferential side.

5. The vane according to claim 4, wherein an area of the shroud body in the circumferential direction, in which the at least one recessed part is arranged, includes a position in the circumferential direction of the shroud body at which a trailing edge of the airfoil section is arranged.

6. The vane according to claim 1, wherein an area of the shroud body in the circumferential direction, in which the at least one recessed part is arranged, includes a center in the circumferential direction of the hook section.

7. The vane according to claim 1, wherein the at least one recessed part of the hook section comprises a plurality of the recessed parts in the circumferential direction of the hook section.

8. A gas turbine comprising at least one of the vane according to claim 1 and a ring segment including:

a ring segment body extending in an axial direction and a circumferential direction; and a hook section comprising a radial protrusion provided on the radially outward side of the ring segment body, protruding toward the radially outward side, and extending in the circumferential direction, and an engaging part protruding in the axial direction from the radial protrusion and extending in the circumferential direction, wherein, the hook section comprises a rear hook arranged on a downstream side in the axial direction, the hook section has at least one recessed part recessed in the axial direction or the radial direction in at least a part of the circumference thereof and reducing a stiffness of the hook section, the at least one recessed part extends completely through the rear hook, the engaging part has a sealing surface which contacts the ring segment support member in the radial direction continuously along an entire circumference of the engaging part, and the sealing surface is not split by the at least one recessed part in the circumferential direction.

9. The gas turbine according to claim 8, wherein the at least one recessed part of the hook section comprises a plurality of the recessed parts in the circumferential direction of the hook section.

10. The gas turbine engine of claim 9, wherein each of the plurality of recessed parts is formed as a cutout in an upstream end of the rear hook.

11. A ring segment of a gas turbine supported in a casing of the gas turbine by a ring segment support member and delimiting an outer circumference of an annular high-temperature gas passage, the ring segment comprising:

a ring segment body extending in an axial direction and a circumferential direction; and a hook section comprising a radial protrusion provided on the radially outward side of the ring segment body, protruding toward the radially outward side, and extending in the circumferential direction, and an engaging part protruding in the axial direction from the radial protrusion and extending in the circumferential direction, wherein, the hook section comprises a rear hook, arranged on a downstream side in the axial direction, the hook section has at least one recessed part recessed in the axial direction or the radial direction in at least a part of the circumference thereof and reducing a stiffness of the hook section, the at least one recessed part extends completely through the rear hook, the engaging part has a sealing surface which contacts the ring segment support member in the radial direction continuously along an entire circumference of the engaging part, and the sealing surface is not split by the at least one recessed part in the circumferential direction.

12. The ring segment according to claim 11, wherein the at least one recessed part of the hook section comprises a plurality of the recessed parts in the circumferential direction of the hook section.

13. A remodeling method for a vane supported in a casing by a vane support member and comprising an airfoil section extending in a radial direction and an outer shroud arranged on a radially outward side of the airfoil section, the outer shroud comprising:

a shroud body which extends in an axial direction and a circumferential direction; and a hook section which has a radial protrusion provided on the radially outward side of the shroud body, protruding toward the radially outward side, and extending in the circumferential direction, and an engaging part protruding in the axial direction from the radial protrusion and extending in the circumferential direction, the hook section including a rear hook arranged on a downstream side in the axial direction, the remodeling method comprising a step of forming at least one recessed part that is recessed in the axial direction or the radial direction, in at least a part of the hook section in the circumferential direction, and reducing a stiffness of the hook section, so as to form a sealing surface which contacts the vane support member in the radial direction continuously along an entire circumference of the engaging part and which is not split by the at least one recessed part in the circumferential direction, wherein the at least one recessed part is formed so as to extend completely through the rear hook.

14. The remodeling method according to claim 13, wherein the at least one recessed part of the hook section comprises a plurality of the recessed parts in the circumferential direction of the hook section.

15. A remodeling method for a ring segment of a gas turbine supported in a casing by a ring segment support member and delimiting an outer circumference of an annular high-temperature gas passage, the ring segment comprising:

a ring segment body extending in an axial direction and a circumferential direction; and a hook section comprising a radial protrusion provided on a radially outward side of the ring segment body, protruding toward the radially outward side, and extending in the circumferential direction, and an engaging part protruding in the axial direction from the radial protrusion and extending in the circumferential direction, the hook section including a rear hook arranged on a downstream side in the axial direction, the remodeling method comprising a step of forming at least one recessed part that is recessed in the radial direction or the axial direction, in at least a part of the hook section in the circumferential direction, and reducing a stiffness of the hook section, so as to form a sealing surface which contacts the ring segment support member in the radial direction continuously along an entire circumference of the engaging part and which is not split by the at least one recessed part in the circumferential direction, wherein the at least one recessed part is formed so as to extend completely through the rear hook.

16. The remodeling method according to claim 15, wherein the at least one recessed part of the hook section comprises a plurality of the recessed parts in the circumferential direction of the hook section.

* * * * *